United States Patent [19]

Forsberg

[11] 4,441,617

[45] Apr. 10, 1984

[54] STORAGE STRUCTURE COMPRISING MOVABLE RACKS

[75] Inventor: Klas Y. Forsberg, Karlstad, Sweden

[73] Assignee: Electrolux Constructor Aktiebolag, Saffle, Sweden

[21] Appl. No.: 274,301

[22] Filed: Jun. 16, 1981

[30] Foreign Application Priority Data

Jun. 27, 1980 [SE] Sweden ..... 8004768

[51] Int. Cl.[3] ..... A47B 53/00

[52] U.S. Cl. ..... 211/1.5; 312/198; 414/331

[58] Field of Search ..... 211/1.5, 122; 312/198, 312/199, 200, 201; 414/331; 104/288, 295

[56] References Cited

U.S. PATENT DOCUMENTS 3,780,852 12/1973 Weiss et al. ..... 211/122
3,957,322 5/1976 Mastronardi et al. ..... 312/198
4,017,131 4/1977 Camenisch ..... 312/198
4,033,649 7/1977 Naito et al. ..... 312/198 X
4,256,355 3/1981 Yamaguchi et al. ..... 312/198
4,307,922 12/1981 Rhodes ..... 211/1.5 X

*Primary Examiner*—Ramon S. Britts
*Assistant Examiner*—Robert W. Gibson, Jr.
*Attorney, Agent, or Firm*—Alfred E. Miller

[57] ABSTRACT

A storage structure comprises several storage racks the majority of which are movable between two end positions in order to form a passageway between two adjacent storage racks. An elongate locking device, for example a safety chain, is arranged between each pair of adjacent storage racks, one end of which is secured to one storage rack. The other end of the locking device is in the form of a contact member, which for starting a process of movement coacts with a stationary contact member in said storage rack. The contact member of the locking device is also connectable to the adjacent storage rack for mechanically locking the passageway which can be formed between the storage racks.

11 Claims, 2 Drawing Figures

STORAGE STRUCTURE COMPRISING MOVABLE RACKS

This invention relates to a storage structure of the type in which storage racks are moved by motors or the like, wherein means are provided to prevent movement when a person is in a passageway between the racks. Simple handling of the storage structure at the same time is desired.

In principle, the safety problems can be solved in two different ways. One way is to provide safety chains or the like between the racks at the opening of each passageway, which prevents or at least warn for entrance during the time a passageway is being formed. According to the other solution the safety chains are omitted but instead safety panels are disposed on the racks along the passageways which when pressed upon, break the supply of current to the structure.

In storage structures with safety chains the structure is operated by push buttons or the like placed on the racks, and after a passageway has been formed the safety chain has to be lifted off. Then the movable racks cannot be moved until the safety chain has again been applied between the racks. This operation is unnecessarily complicated and slow, since both push button and chaon have to be operated before a passageway will be accessible.

Although, in storage structures with safety panels the operation is simpler, the arrangement with double panels on each storage rack involves increased cost. Hence it is desired to omit such panels.

The invention relates to a storage structure with racks having safety chains or similar locking means, and the main object of the invention is to simplify handling without diminishing the safety.

Figure 1:
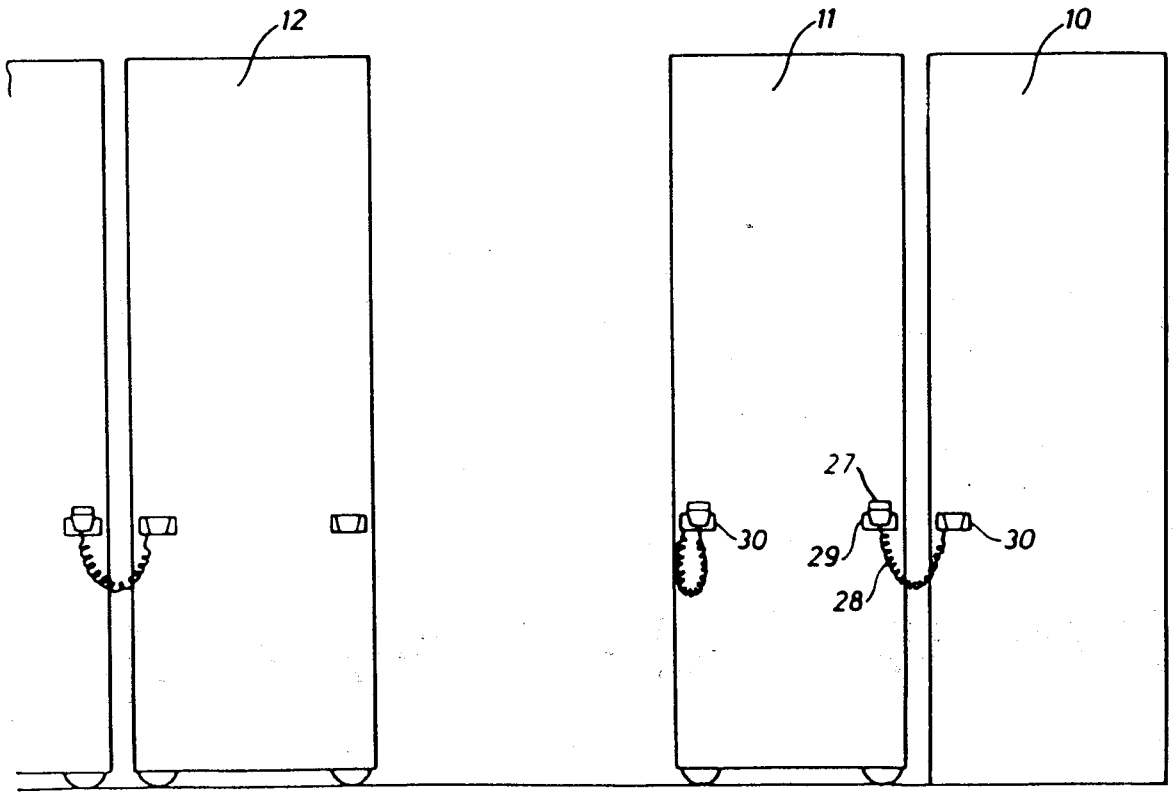
Figure 2:
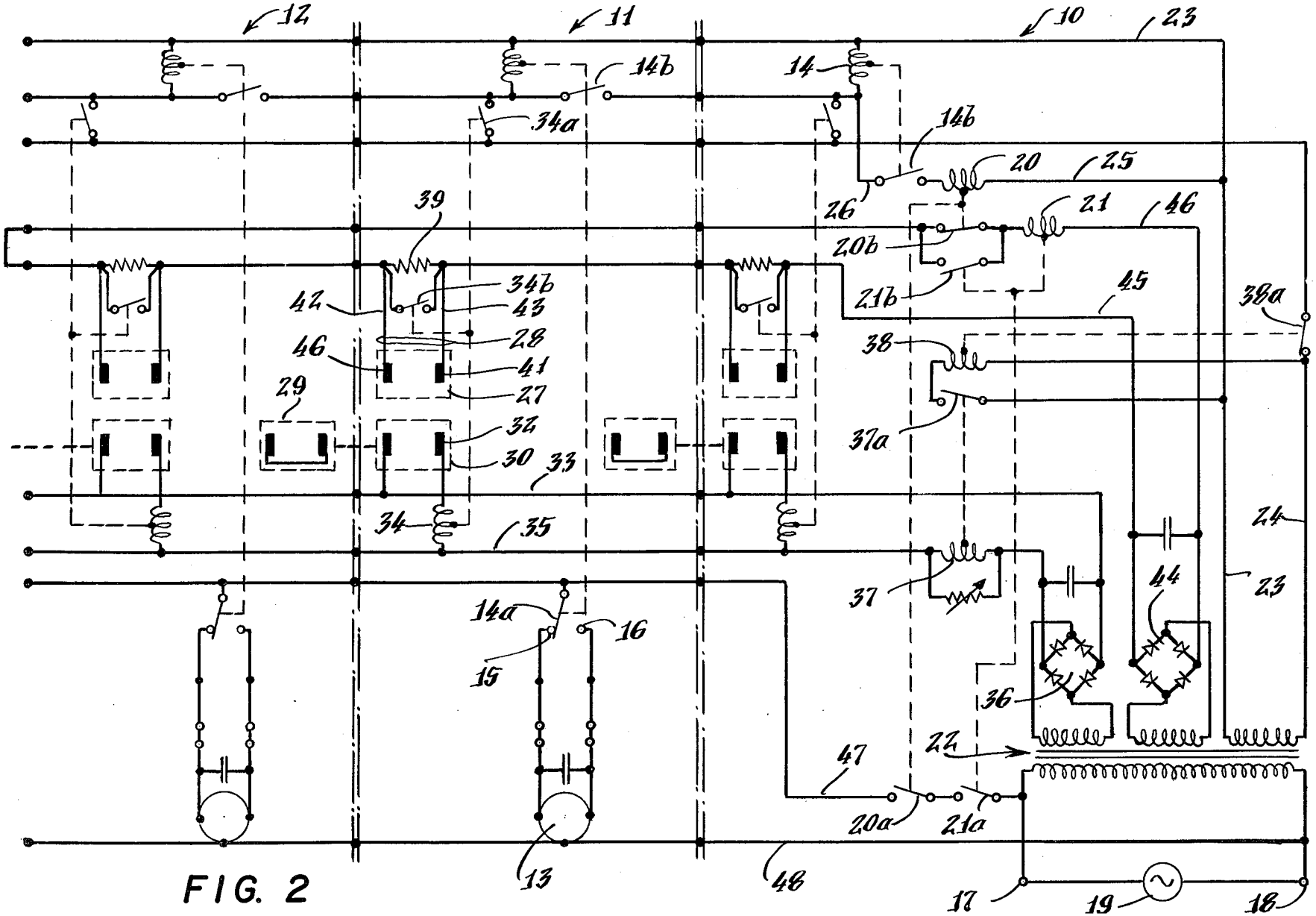

Other objects and advantages of the invention will become apparent in the following description of an embodiment referring to the accompanying drawing, wherein FIG. 1 is a simplified diagram of a storage system in accordance with the invention and FIG. 2 is a circuit diagram of a storage structure according to the invention.

In the illustrated embodiment the storage structure comprises a stationary storage rack 10 and several movable storage racks of which two, 11 and 12, are shown. Identical parts of the different racks in the following have identical references.

Each movable rack has an electric motor 13 which via a reversing contact 14*a* of a relay 14 placed in the rack is reversable between left-hand and right-hand movement. For this purpose the reversing contact 14 coacts with two stationary contacts 15, 16. When the relay 14 is not activated the reversing contact 14*a* is connected to the contact 15, whereby the motor is prepared for moving the rack 11 to the left in the Figure. When the relay 14 is activated the contact 14*a* shifts its position and is brought to rest against the contact 16 which causes the motor to be prepared for movement to the right in the Figure. The motors are via two conductors 47, 18 connected to two terminals 17, 18, which in turn are connected to an AC power source 19. The feed circuit to the motors includes two relay contacts, one 20*a* of which is controlled by a relay 20 common for all storage racks and the other one 21*a* is controlled by a safety relay 21.

The common relay 20 is included in a control circuit which is fed by alternating current and via which signals are transferred from the storage racks to the common relay to start a process of movement. The control circuit is fed from a transformer 22 via conductors 23, 24. The relay 20 is supplied with current from the conductor 23 via a conductor 25 and is via a conductor 26 and a contact 14*b* connected to one end of the relay 14 in the stationary rack 10. All the storage rack relays 14 are supplied via the conductors 23 and 26 and a rack contact 14*b* is interconnecting the ends of each pair of adjacent relays 14 which are supplied from conductor 26.

For operating the storage racks the latter have activating means in the form of a two-pole contact member 27 arranged in one end of an elongate locking means in the form of a helical cord or the like, which is diagrammatically indicated and referred to by 28. The contact member 27 is normally intended to be connected to a short-circuiting clamp 29 disposed at the adjacent storage rack 12. Thus, the helical cord will extend between the racks 11 and 12 and indicate that entrance is not permitted.

The contact member 27 can also be connected to a stationary contact member referred to by 30. This member comprises two contacts 31, 32, of which the contact 31 is connected to a conductor 33 and the contact 32 via a high-ohmic relay 34 is connected to a conductor 35. The conductors 33, 35 are via a rectifier 36 connected to the transformer 22 and supply direct current to the relays 34. In the feed circuit also a current-sensing relay 37 is included, which by a contact 37*a* activates a relay 38 connected to the conductors 23, 24. Via a contact 38*a* the relay 38 controls the supply of current via the conductors 23 and 24 to the relays 14 and 20. The high-ohmic relay 34 acts on a contact 34*a* which is connected between the conductors 24 and 26 and thus in the respective storage rack to that part of the conductor 26 which is connected to the storage rack relay 14.

In the storage structure a special safety circuit is provided which in addition to the safety relay 21 comprises a high-ohmic resistor 39 in each storage rack and a contact 34*b* bridging the resistor and being acted upon by the relay 34. Via the helical cord 28, which contains conductors 42, 43, the resistor is also connected to the contact member 27 having two contacts 40, 41. The safety circuit is supplied with current from the transformer 22 via a rectifier 44 and conductors 45, 46. As seen in the Figure, the safety circuit comprises a loop including the resistors 39 with bridging contacts 34*b* and 40, 41, and 29, respectively, the relay 21 and additionally two contacts coupled in parallel, of which one 20*b* is controlled by the common relay 20 and the other 21*b* is controlled by the safety relay 21. The expressions high-ohmic resistor and high-ohmic relay used above and in the following are relative to normally low-ohmic relays and current circuits. The resistor thus has a value of one or a few kiloohms, which is to be considered as high-ohmic relative to the impedance of the relay 21. Thus the relay cannot be activated if anyone of the resistors 39 were coupled in series. The matter is different as regards the high-ohmic relay 34, which is dimensioned for being activated by a resistor 39 coupled in series.

The storage structure operates in the following manner.

Assuming that all the contact members 27 are connected to the short-circuiting clamps 29, then all the resistors 39 will be short-circuited. Hence, the relay 21, which is low-ohmic, will be energized and thus the contacts 21*a*, 21*b* will be closed. Thus the safety circuit is closed and the feed circuit of the motors 13 prepared for starting. In this position it is assumed that the contact member 27 of the storage rack 11 is moved from the short-circuiting clamp 29 of the storage rack 12 and is brought into contact with the stationary contact member 30 of the storage rack 11. This indicates that a passageway is desired between the racks 11 and 12. Thus, the movement of the contact member 27 carries out two functions. Firstly the mechanical locking between the storage racks 11 and 12 is discontinued, and secondly an impulse for starting the process of movement is given. The contact member 27 moving to the contact member 30 causes the short-circuiting of the resistor 39 to cease at the same time as a circuit is established from the conductor 35 via the relay 34, contacts 32, 41, conductor 43, resistor 39, conductor 42 and the contacts 40, 31 to the conductor 33. Thus the high-ohmic relay 34 pulls and closes the contacts 34*a* and 34*b*. The time of movement of the contact member 27 is sufficient for the safety relay 21 to drop. However, closing of the contact 34*b* causes the resistor 39 to be short-circuited again so that the relay 21 will be reenergized.

Closing of the contact 34*a* causes the relay 14 in the rack 11 to be connected over the feed conductors 23 and 24. Thus the relay 14 pulls and closes the contact 14*b* located to the right of it. The relay 14 in the stationary rack 10 is thereby connected to the feed conductors 23, 24, and also this relay pulls and closes its contact 14*b*. Thereby the common relay 20 is connected between the feed conductors 23 and 24, and the relay 20 pulls thus closing the contact 20*a* but opening the contact 20*b*. Closing of the contact 20*a* causes the motors 13 of the racks to be fed with current, and the interconnection is so formed that the rack 11, in which the relay 14 has pulled, by closing of the contact 14*a* has been prepared for movement to the right towards the stationary rack 10, whereas all the other movable racks, in which the relay 14 remains inactivated, are prepared for movement to the left in the Figure. When the racks after having moved have reached their end positions, determined by end position contacts, not shown, a passageway has been formed between the racks 11 and 12.

When the work in the passageway has been finished the contact member 27 in the rack 11 is again brought to the short-circuiting clamp 29 on the rack 12 and the structure is to be prepared for a new process of movement. When the contact member 27 is removed from the contact member 30, the relay 34 drops and opens the contact 34*b* as well as the contact 34*a*. Opening of the contact 34*b* causes the safety relay 21 to drop and to open the contact 21*a* and the contact 21*b*. When the contact 34*a* is opened the relay 20 drops closing the contact 20*b* and opening the contact 20*a*. When the contact member 27 has been placed on the short-circuiting clamp 29, the resistor 39 is again short-circuited so that the relay 21 pulls and closes the contact 21*a*. Thus, the safety circuit is again intact and permits another process of movement to start.

If a passageway has been formed between two racks and somebody lifts off the contact member 27 from the short-circuiting clamp 29 between two other racks, a resistor 39 in the safety circuit will immediately be connected and cause the relay 21 to drop. To form a new passageway two measures are required, viz. the contact member 27 at the open passageway must be removed from the contact member 30, so that the relay 20 drops, and further those contact members 27 which are not already connected to the relevant short-circuiting clamps must be brought to these in order to short-circuit all the resistors 39 thereby closing the safety circuit. Not until this is accomplished can anyone of the contact members 27 be brought to the relevant contact member 30 for starting a new process of movement.

To increase the safety in case of current supply failure there are provided relays 37 and 38. This is because it may occur that a passageway has been formed and the relevant locking means has been lifted off and that simultaneously another locking means has been moved to start position with the relevant contact member 27 connected to the corresponding contact member 30. A following power failure will result in that both the relay 20 and the relay 21 will be inactivated. This means that when the power returns, the contact 20*b* will remain closed at the same time as no resistor 39 is connected. As a consequence the relay 21 will pull and close the contact 21*a* and simultaneously double signals for movement will be given so that relevant relays 34 as well as the relays 14 and the relay 20 will pull. Thus, when the contact 20*a* is closed it may occur that movement takes place in spite of a person being present in the available passageway. This is effectively prevented by the current-sensing relay 37 which senses whether one or several relays 34 are pulled. In the latter case the relay 37 will pull and close the contacts 37*a*, which activates the relay 38 so that it will in turn open the contact 38*a*. Thereby the current via the conductors 23, 24 to the relays 14 and 20 is stopped and these relays will drop. Those of the relays 14 which have been activated will then shift the contact 14*a* so that all the motors will be prepared for movement to the left. The relay 20 opens the contact 20*a* so that all the motors will be without voltage. Further the relay 20 closes its contact 20*b*, whereby the safety circuit will be prepared for being activated again after a break caused by the resetting of the contact members 27. A new process of movement cannot be started until all the contact members have been connected to the relevant short-circuiting clamp 29, because each removal of a contact member 27 from the relevant contact member 30 causes the safety relay 21 to drop. After this has occurred starting again is possible only provided that the safety circuit is closed and the relay 21 activated while the relay 20 is inactivated. A provision for the latter condition is that all the contact members 27 are connected to the relevant short-circuiting clamp 29. When the contact members 27 are reset the relay 37 drops and hence also the relay 38, which closes the contact 38*a* to permit supply of current to the realy 20.

What is claimed is:

1. In a storage structure comprising several aligned storage racks, the majority of which are movable between two end positions in order to form a passageway between two adjacent storage racks, an elongate locking means arranged between each pair of adjacent storage racks, and an activating member for starting the process of movement arranged on each storage rack, the improvement wherein one end of the elongate locking means is secured to one of a pair of storage racks and the other end thereof is connected to the activating member, said activating member comprising a movable contact member selectively connectable to a stationary contact member on said one of a pair of storage racks for starting process of movement and to the adjacent storage rach for mechanical locking of the passageway formed between the storage racks.

2. The storage structure according to claim 1, wherein each movable storage rack comprises an electric motor which is reversible for right-hand and left-hand movement, respectively, said motor being connected to an electric power source via a feeding conductor common to all storage racks, said motor being coupled in series with a first contact operated by a safety relay which is included in a safety circuit together with the movable contact members, the first contact being closed only when one of the movable contact members has been moved into contact with the stationary contact means at the same time the other movable contact members are connected to the respective adjacent storage racks.

3. The Storage structure according to claim 2, wherein the movable contact member connected to the elongate locking means is comprised of two contacts bridged by a high-ohmic resistor connected in the safety circuit by a high-ohmic relay connected to the power source in series with two contacts in the respective stationary contact member, the movable contact member being connectable to a short-circuiting clamp disposed at the adjacent storage rack.

4. The storage structure according to claim 3, wherein a short-circuiting circuit including a contact controlled by the high-ohmic relay is coupled in parallel with the high-ohmic resistor.

5. The storage structure according to claim 3 or claim 4, wherein the feeding conductor is common to all the motors, and is coupled in series with an additional contact controlled by a further relay disposed in a stationary storage rack and connected to all storage racks, the further relay being connected to the power source via a circuit including contacts coupled in parallel and corresponding in number to the number of storage racks, each of said last mentioned contacts being controlled by the high-ohmic relay in the relevant storage rack.

6. The storage structure according to claim 5, wherein the storage racks are provided with control relays of which the control relay in the stationary storage rack controls a contact arranged in the feed circuit for the further relay, and the control relay in each of the movable storage racks controls a series contact coupled in the feed circuit for the further relay between said parallel coupled contacts, the series contacts being located between the relevant storage rack and the adjacent storage rack as seen in the direction toward the stationary storage rack.

7. The storage structure according to claim 6, wherein the control relay in the movable storage racks controls the direction of movement of the respective motor in such a manner that when the control relay is activated the motor is connected for movement of the storage rack in the direction toward the stationary storage rack.

8. The storage structure according to claim 6 wherein the further relay has a contact connected in the feed circuit for the safety relay and is coupled in parallel with a contact controlled by the safety relay, the two contacts being controlled in such a manner that activation of the further relay disconnects the relevant contact whereas activation of the safety relay connects the relevant contact.

9. The storage structure according to claim 8, wherein a current-sensing relay is included in the feed circuit for the high-ohmic relays and is designed in such a manner that when one of the high-ohmic relays is activated the supply of current to the structure is maintained whereas when two or several of the high-ohmic relays are activated simultaneously the supply of current is discontinued.

10. The storage structure according to claim 9, wherein the high-ohmic relays are connectable in parallel with the power source, the current-sensing relay being coupled in series with the high-ohmic relays and which control a contact placed in the feed circuit for the further relay.

11. The storage structure according to claim 1 wherein said elongate locking means comprises a safety chain.

* * * * *